US009301600B1

(12) United States Patent
Duggal

(10) Patent No.: US 9,301,600 B1
(45) Date of Patent: Apr. 5, 2016

(54) VERSATILE GLIDER SUPPORT

(71) Applicant: Jatinder Singh Duggal, Kansas City, MO (US)

(72) Inventor: Jatinder Singh Duggal, Kansas City, MO (US)

( * ) Notice: Subject to any disclaimer, the term of this patent is extended or adjusted under 35 U.S.C. 154(b) by 0 days.

(21) Appl. No.: 14/623,168

(22) Filed: Feb. 16, 2015

(51) Int. Cl.
*B43L 15/00* (2006.01)
*A47B 21/03* (2006.01)

(52) U.S. Cl.
CPC ..... *A47B 21/0371* (2013.01)

(58) Field of Classification Search
CPC ..... A47B 21/0371; Y10S 248/918; A63B 21/0004
See application file for complete search history.

(56) References Cited

U.S. PATENT DOCUMENTS 5,265,835 A * 11/1993 Nash ..... A47B 21/0371 248/118
5,472,161 A 12/1995 Krukovsky
5,730,711 A 3/1998 Kendall et al.
5,927,663 A * 7/1999 Tseng ..... A47B 21/0371 248/118.5
6,149,234 A * 11/2000 Daniels ..... A47C 1/143 297/188.06
7,183,523 B2 2/2007 Lu
2008/0272250 A1 11/2008 Oh et al.
2015/0351564 A1* 12/2015 Vogel ..... A47G 9/10 5/640

FOREIGN PATENT DOCUMENTS

CN 102662503 9/2012
CN 202838238 3/2013
WO 0236050 5/2002

OTHER PUBLICATIONS

CN 102662503, Qisda Technology Co., Ltd.—English. Sep. 12, 2012.
CN 202838238, Panzhihua University—English. Mar. 27, 2013.

* cited by examiner

*Primary Examiner* — Amy Sterling
(74) *Attorney, Agent, or Firm* — McKee, Voorhees & Sease, PLC

(57) ABSTRACT

A glider consisting preferably of a silicone molded platform with eight roller balls strategically placed on the undersurface of the platform. The glider provides a mobile cushion to support a wrist, elbow or forearm while actively mousing, drawing, or performing other tasks. The glider can be used independently or with a cushion positioned on the top of the platform. It can be placed under the wrist to help alleviate repetitive stress injuries such as carpal tunnel by maintaining the wrist in a neutral position. Versatility is offered by allowing use of the glider alone, cushioning alone, or combinations of glider and cushioning with various cushions.

7 Claims, 4 Drawing Sheets

VERSATILE GLIDER SUPPORT

FIELD OF THE INVENTION

This invention relates to improvements in the field of ergonomic supports for wrist, palm, forearm and/or elbow. It is primarily for avoidance of repetitive movement injuries, such as occur at a computer with constant computer mousing and typing and/or as occur at engineering drawing boards, etc.

BACKGROUND OF THE INVENTION

As increased amounts of work, education and recreation incorporate the use of computers, repetitive strain and stress injuries to the hands, wrists and arms and related conditions, such as carpal tunnel syndrome, become more prevalent. Generally, these injuries result from the use of computer mice and keyboards and often occur from repeated physical movements, damaging tendons, nerves, muscles and other soft body tissues. These injuries present a serious and very painful condition that is far easier to prevent than to cure once onset occurs, and can crop up even in young, physically fit individuals. Often times, these injuries cause people to leave computer dependent careers, or even to be disabled and unable to perform mundane tasks which are generally taken for granted.

While the above description of the background problems is normally given in the context of repetitive stress injury caused by computer usage, it should be mentioned that there are other common occupations that involve similar repetitive stress injuries and even stress injuries to the elbow. Notable among those are artists that use drawing boards and such occupations as engineers, architects, cartoonists, etc.

Many support and wrap devices are commercially available to alleviate or prevent injuries associated with repetitive stress and strain to the wrist area. In particular, wrist rests and supports used in conjunction with keyboards and computer mice are widely available, whereon a user's wrists rest on a soft elongated pad which provides support while redirecting pressure points in the area. Devices of this type are further designed with the structure for keeping the wrist in a given position at all times in order to prevent injury while using a personal computer and other desktop devices.

A primary shortcoming of the many wrist support devices referenced above includes the fact that they lack versatility, that is to say, most are specific to one activity. There is a need for a versatile unit which can be used to provide frictionless movement of the forearm, elbow, wrist, etc. across a stationary surface, and which can be used to provide cushioning support to help keep the wrist in a neutral position and/or alleviate the stress at the forearm or the elbow caused by constant movement across a stationary surface.

Accordingly, it is an object of the present invention to provide an improved versatile glider and support usable in a variety of configurations, including use with a variety of different type of cushions.

It is another objective of the present invention to provide a support device that may be individually customized for a particular job by use of various configurations, such as pad, no pad, glider, no glider, and pillows or cushions filled with different materials to provide different cushioning affects.

The method and manner for achieving the above recited objects, as well as others, will be apparent from the detailed description of the invention that follows.

SUMMARY OF THE INVENTION

A glider consisting preferably of a silicone molded platform with eight roller balls strategically placed on the underside of the platform. The glider provides a mobile cushion to support a wrist, elbow or forearm while actively mousing, drawing, or performing other tasks. The glider can be used independently or with a cushion positioned on the top of the platform. It can be placed under the wrist to help alleviate repetitive stress injuries such as carpal tunnel by maintaining the wrist in a neutral position. Versatility is offered by allowing use of the glider alone, cushioning alone, or combinations of glider and cushioning with various cushions.

DETAILED DESCRIPTION OF THE PREFERRED EMBODIMENTS

Figure 1:
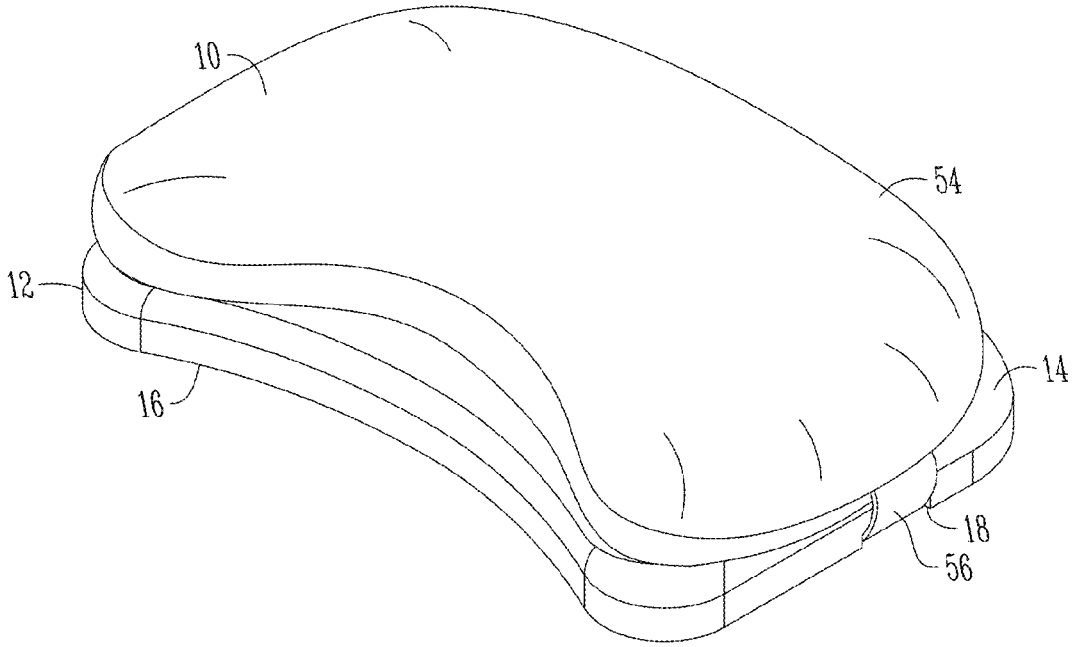
FIG. 1 is a perspective view of a versatile glider support with a pad attached to its top.

Referring to the drawings, particularly FIGS. 1-5, there is shown the glider support with its pad 10, comprised of a polymeric molded platform 12, preferably a silicon molded platform 12, having an upper surface 14 and a lower surface 16. The preferred shape of the platform 12 is shown in the bottom view of FIG. 2, as this conforms better to hand grasping, that is to say a configuration that has an indent curve on one side thereof.

Figure 5:
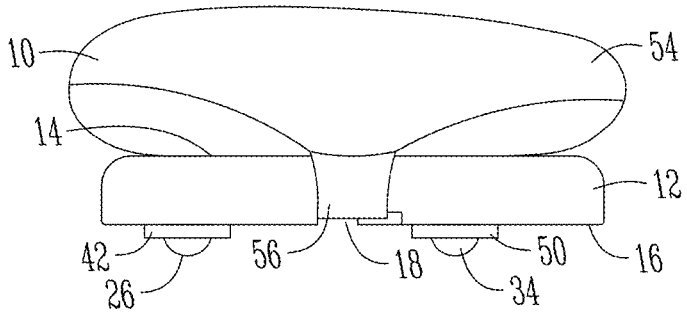
FIG. 5 is a side elevation view of the pad showing with more particularity the protruding bearings.
Figure 6:
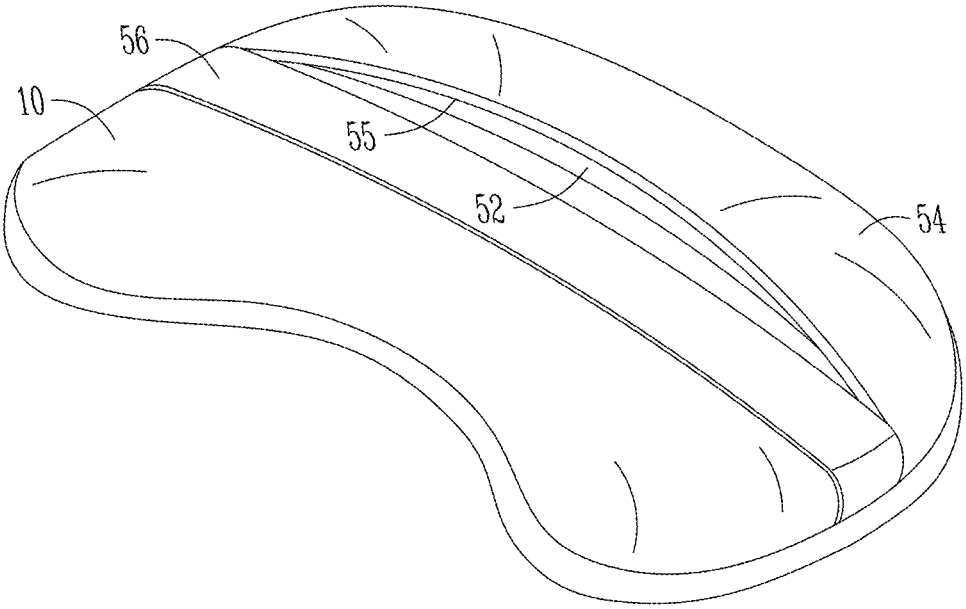
FIG. 6 shows a perspective view of the pad cover, with its attached strap and its open slit to allow insertions of various cushions.

The lower surface 16 of the platform 12 has an intentionally cut groove 18 along its longitudinal axis which is spaced between the two rows of strategically placed ball bearings, as pictured there is shown eight ball bearings more or less evenly spaced on each side of the groove 18 at 20, 22, 24, 26, 28, 30, 32, and 34 to define two balanced rows of four ball bearings. As best seen in FIG. 5, each of the ball bearings 20-34 protrude outwardly below the lower surface 16 of platform 12 and reside in bearing housings 36, 38, 40, 42, 44, 46, 48 and 50. Ball bearings 20-34 are positioned in the bearing housings 36-50 so that they are rotatably mounted therein. Preferably, the bearing housings 36-50 are made of ABS (Acrylonitrile butadiene styrene). They therefore provide near frictionless ball bearing rollers for allowing the platform 12 to glide over any surface, such as a desktop surface.

Figure 2:
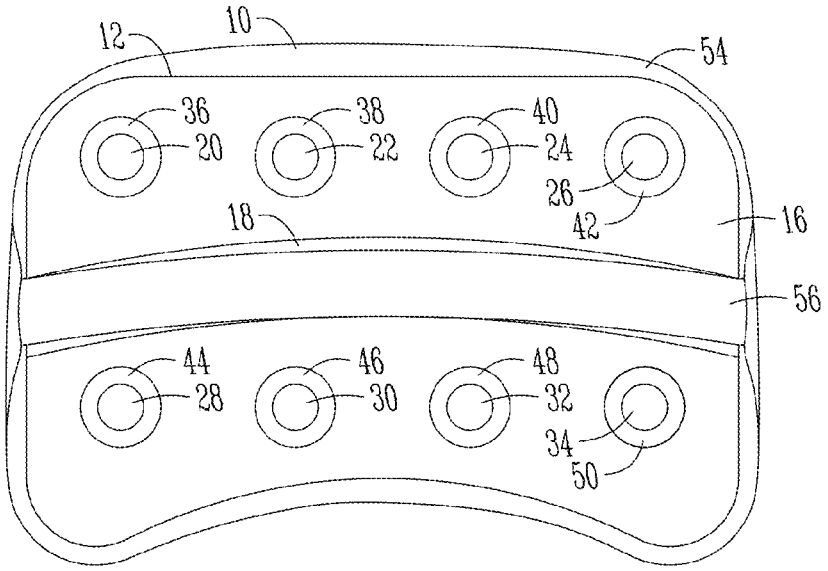
FIG. 2 is a bottom view of the versatile glider support with a pad attached to its top.
Figure 3:
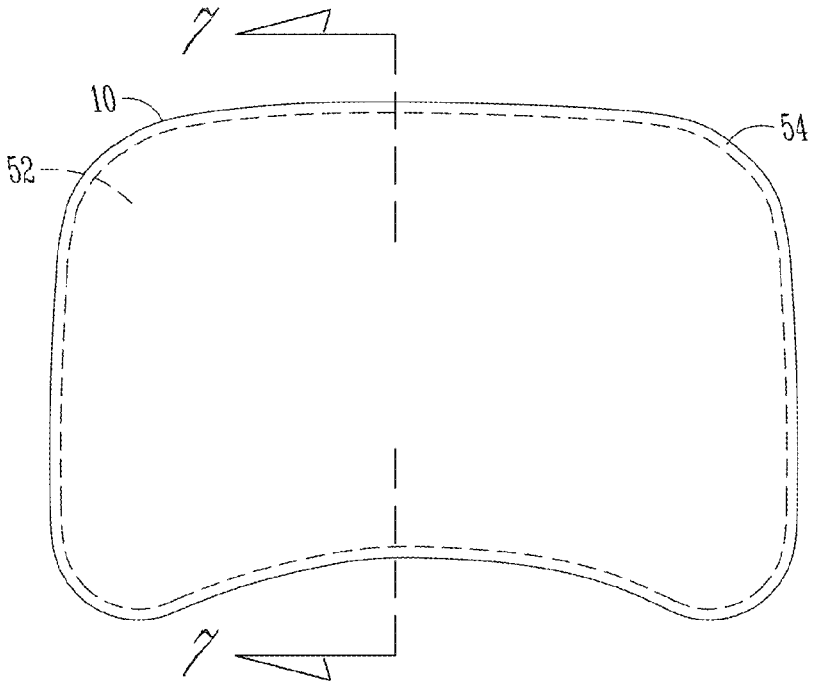
FIG. 3 is a top view of the pad and glider.
Figure 4:
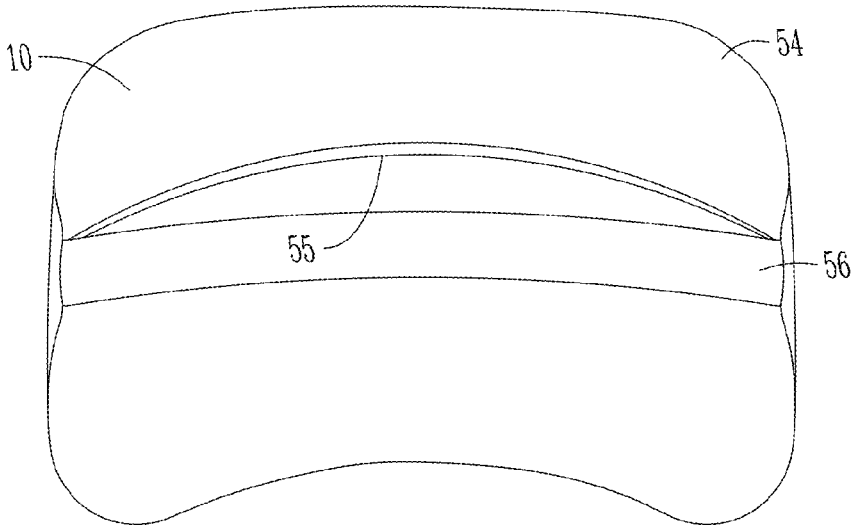
FIG. 4 is a bottom view of the glider and pad combination.

Positioned on the upper surface 14 of platform 12 is a removable cushion 52 which may be attached to the platform 12 by placing cushion 52 inside of cover 54 through the insert slot 55 and attaching it to the platform 12 by a strap 56 nesting in groove 18 as depicted in FIGS. 1 and 2. In this way, the strap 56 does not interfere with gliding movement.

Figure 7:
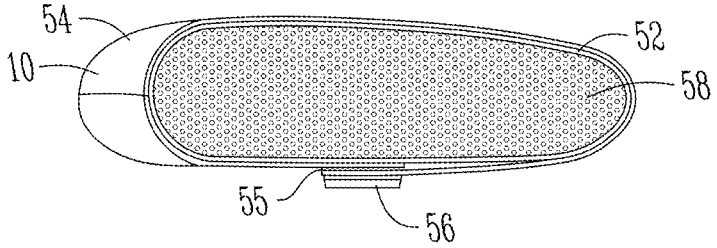
FIG. 7 is a picture of an exemplary cushion, in this case filled with ergo beads.

It is important to remember that cushion 52 is filled with resiliently deformable material 58 (see FIG. 7). The cover 54 and cushion 52 can each be made of stretchable material, such as cotton and spandex material, preferably 92% cotton and 8% spandex.

Deformable insert pad 52 is filled with a granular filling material 58 that may be a plurality of small, tightly packed pellets or beads, hereinafter referred to collectively as beads. The deformable material 58, such as beads, is shown in the cut-away portion of FIG. 7 that shows filling material 58. Beads of filling material 58 may be oval, elliptical, round, disc or egg-shaped, without sharp or rough edges and with a completely smooth exterior. The exemplary beads 58 or other filling material 58 is tightly packed in a corresponding cushion 52 that forms deformable insert pad 52, to a sufficiently high density so that deformable insert pad 52 is moldable as the beads smoothly redistribute responsive to the underlying structure and the position of the wearer's hand, arm, etc. The packing and configuration may be so as to provide a resiliency to deformable insert pad 52.

Filling material 58 may be tightly or loosely packed within the cushion to provide complete and smooth moldability. Filling material 58 may be advantageously formed of thermal storage material capable of maintaining a reduced temperature for an extended period of time. By reduced temperature, it is meant that the temperature of the thermal storage material is lower than that of the ambient environment. The reduced temperature may be a temperature at or below 32° F., a temperature at or below 40° F., or any temperature that is less than room temperature. In one exemplary embodiment, ergo-Beads™ may be used as filler material 58. Since filling material 58 is advantageously formed of a population of small beads 58 with tiny air pockets between the beads, it provides a more comfortable soothing feel. The beads 58 may be warmed, if desired. Deformable insert pad 52 has a smooth conformal nature that is more comfortable than the lumpy surface of other fill materials which includes sharp or hard edges. According to the embodiment in which filling material 58 is a thermal storage material, the thermal storage material may additionally or alternatively be chosen to retain heat and provide soothing warmth. Various thermal storage materials may be used.

Exemplary beads 58 of filling material 58 have smooth exterior surfaces. In an exemplary embodiment, beads 58 may be formed of low density polyethylene ("LDPE") and may be natural or semi-clear white in color. They may be injection molded or extrusion type LDPE particles. Beads 58 are free of sharp edges and include a surface that has an average surface roughness of less than 100 nanometers in one exemplary embodiment enabling the beads to slide easily and freely against each other. The beads' surface may advantageously be polished to enhance smoothness. A coating may optionally be added to filling material 58, in particular coating the surfaces of beads 58. The coating may be a powdery coating formed of a mold-release agent such as an amide, or other materials that provide lubrication. Beads 58 maintain their surface smoothness and the easy deformability of deformable insert pad 52 is retained at a range of temperatures.

Exemplary illustrated disc shaped beads 58 may include a pair of opposed round or oval surfaces and a length chosen to be less than or equal to 4.5 millimeters in one exemplary embodiment. Beads 58 may include dimensions of 3 millimeters.times.4.5 millimeters.times.2 millimeters and a density of 0.910 to 0.935 grams per cubic centimeter but other sizes and densities may be used in other exemplary embodiments, however. In another exemplary embodiment, beads 58 may include dimensions of about 6 millimeters.times.4 millimeters.times.3 millimeters. The exemplary dimensions provided are illustrative but not restrictive of the bead dimensions as other dimensions may be used in other exemplary embodiments. The beads may optionally include at least one dimple. Filler material 58 is packed tightly enough so that deformable insert pad 52 is deformable or moldable as the beads redistribute responsive to contact surfaces and positioning by the wearer. When deformable insert pad 52 is in contact with a wearer, a gentle massaging action is created by filling material 58 when pressure such as a gentle rolling action is applied to the opposed side of deformable insert pad 52.

Other filling material other than the preferred ergo beads may be used if desired, for example, even some fine grains of sand, etc.

It can be seen that the versatile glider support 10 can be used in a variety of combinations. For example, it can be used with a pad, without a pad, the pad can be of ergo beads, a pad of silicone or visco-elastic polymer, a pad of sand, or with a pad of other filler material, even sawdust. It can also be used with a glider, or without a glider and with a pillow cover or without a pillow cover all at the option of the user. This facilitates support and customized adjustment for support of the wrist, support of the palm, support at the forearm, and support at the elbow, again all at the option of the user. Therefore, it can be seen that the invention accomplishes all of its stated objectives.

What is claimed is:

1. A versatile glider support, comprising:

a platform having upper and lower surfaces;

a plurality of protruding rotatable bearings mounted in said lower surface;

a groove in said lower surface along a longitudinal axis thereof;

a cushion pad removably positioned on top of said platform;

said cushion being loosely filled with granular material, and being in a cover attached to said platform by a strap through said groove in said lower surface.

2. The glider support of claim 1 wherein the bearings are each mounted in an ABS housing.

3. The glider support of claim 1 wherein the cushion pad is removably positioned in a pad cover.

4. The glider support of claim 1 wherein the cushion pad is filled with deformable polymeric plastic beads.

5. The glider support of claim 4 wherein the plastic beads are ergo beads.

6. The glider support of claim 1 wherein the platform is made of silicone rubber.

7. The glider support of claim 3 wherein the cover is a stretchable cotton and spandex material.

* * * * *